United States Patent [19]

Hintsa et al.

[11] 4,438,613

[45] Mar. 27, 1984

[54] SUSPENDED CEILING PANEL SYSTEM

[75] Inventors: Roy A. Hintsa, Etobicoke; Tonu Orav, Thornhill, both of Canada

[73] Assignee: Decoustics Limited, Rexdale, Canada

[21] Appl. No.: 277,166

[22] Filed: Jun. 25, 1981

[51] Int. Cl.[3] ..... E04B 5/52

[52] U.S. Cl. ..... 52/484; 49/465; 52/488; 52/489; 52/813; 52/822

[58] Field of Search ..... 52/484, 485, 486, 488, 52/489, 804, 802, 813, 822; 49/463–466; 160/381

[56] References Cited

U.S. PATENT DOCUMENTS

| | | | |
|---|---|---|---|
| 2,065,796 | 12/1936 | Davis | 52/485 |
| 2,101,349 | 12/1937 | Sharp | 160/381 UX |
| 2,616,197 | 11/1952 | Osburn | 52/813 X |
| 3,279,139 | 10/1966 | Stahlhut | 52/779 |
| 3,513,613 | 5/1970 | Jones et al. | 52/779 X |
| 3,930,338 | 1/1976 | Rood | 52/489 X |
| 4,004,390 | 1/1977 | Merkwitz | 52/484 |
| 4,019,300 | 4/1977 | Sauer et al. | 52/484 X |
| 4,027,446 | 6/1977 | Brugman | 52/484 |

*Primary Examiner*—Philip C. Kannan

[57] ABSTRACT

According to the present invention, a new suspended ceiling system is possible of the type having a plurality of removable panels which are supported below a grid network. The grid network comprises structural elements interconnected by junction members with the cells of the grid network sized to receive a panel about the periphery thereof. These structural members cooperate with framed panel members to accurately align adjacent panels and position them at a certain height below the grid network. Access to the area above the panels is easily obtained by removal of any of the panel members. Each panel is urged into abutting contact with the grid network to provide a seal therewith such that the area above the ceiling may be used as a return air plenum. The particular frame member for the panels facilitates mechanical connection about and to the body member of the panel and also simplifies removal of the panel.

26 Claims, 18 Drawing Figures

FIG.7.
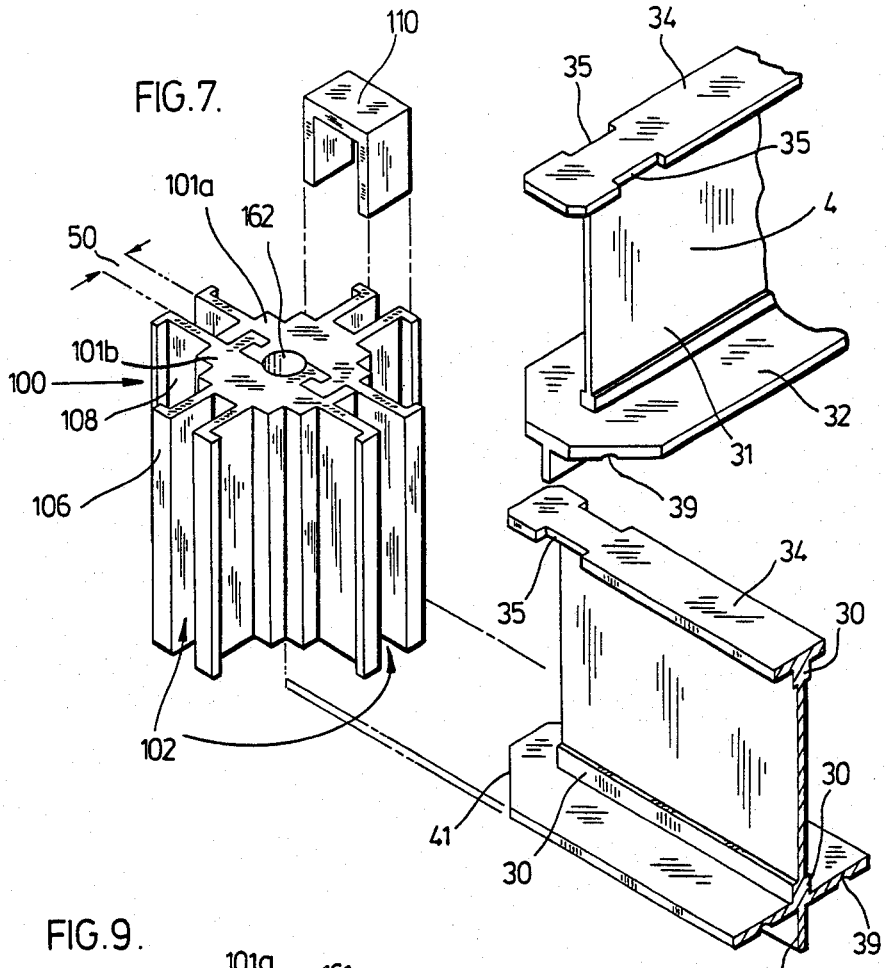
FIG.9.
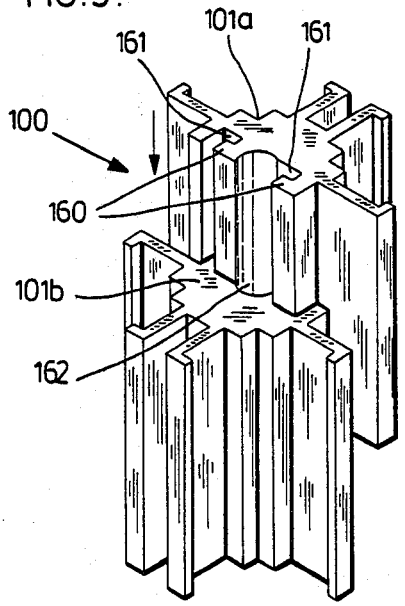
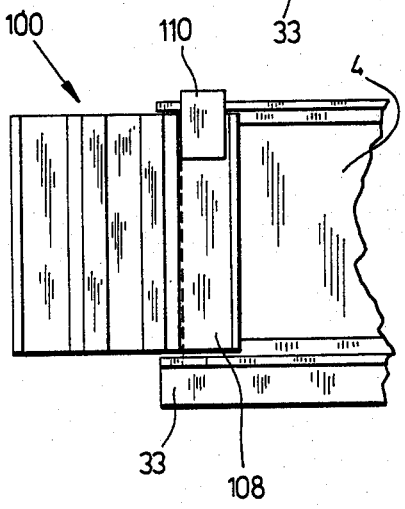
FIG.8.

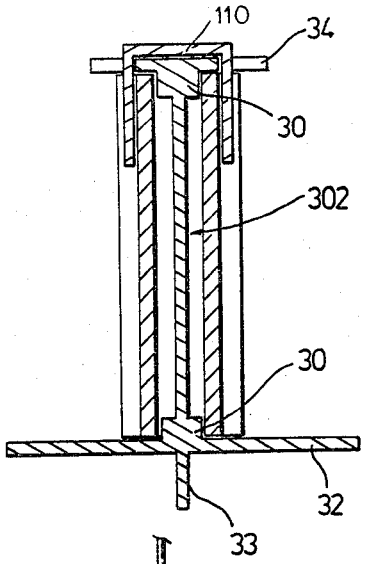
FIG. 10.
FIG. 11.
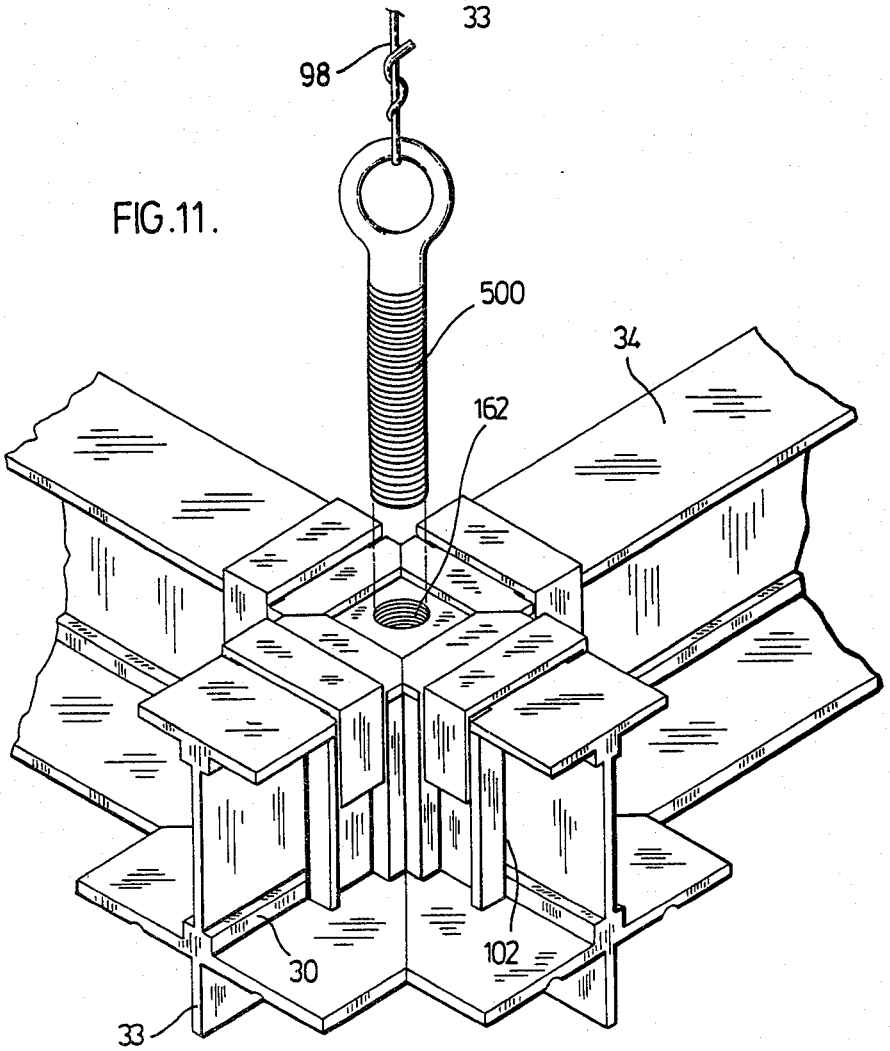

SUSPENDED CEILING PANEL SYSTEM

FIELD OF THE INVENTION

The present invention relates to suspended ceiling systems and particularly ceiling systems where access to the area above the ceiling may be required.

BACKGROUND OF THE INVENTION

Suspended ceiling systems and structural supports therefore are widely used in building constructions to provide a simple ceiling system which can easily be installed in place. Although these structures function satisfactorily, they are not aesthically pleasing and fully concealed panel systems have been designed to overcome this problem.

U.S. Pat. No. 3,513,613, which issued to I. P. Jones et al, May 26, 1970, is one structure which provides a fully concealed ceiling panel system. This system utilizes a fibrous panel board having a flexible sheet material adhered to a major surface thereof, such that an edge portion of this flexible sheet extends laterally beyond the side edges of the body. The structural support elements, which position and secure the panels, are provided with a centre recess into which the overhanging sheet material may be inserted. In this manner, the panels are supported by the sheet material beneath the support elements and the support elements are not visible from the underside of the ceiling. As can be seen in FIGS. 1 through 3 of this patent, the structural elements disclosed therein cooperate with slotted recesses provided in the side edges of the fibre board of the ceiling panel to assist in supporting the panel.

U.S. Pat. No. 3,279,139, which issued to L. G. Stahlhut, Oct. 18, 1966, discloses a suspended ceiling grid system wherein the structural elements, which provide the grid system for supporting the ceiling tiles, are adapted for ease of connection. However, as can be seen in the drawings of this patent, these support members are visible from the lower side of the ceiling when the panels are installed and as such do not provide a fully concealed ceiling panel system.

Prior art systems have disclosed suspended ceiling panel systems which utilize rectangular or square shaped panels. However it is desirable in certain applications to use panels of different geometric shape. According to the present invention, a support system is provided which can be used to support hexagonal, octagonal, triangular or other geometric shaped ceiling panels.

In building construction applications long lengths of ceilings are common and this presents problems with most ceiling panel systems, whether of the fully concealed type or where the support members are visible from the underside of the ceiling. The first problem, particularly common to fully concealed panel systems, is that the abutting edges of adjacent panels are difficult to align and position at one level below the support members. This alignment problem can readily be identified from the lower side of the ceiling resulting in an inferior installation. Furthermore, differences in height are readily visible due to the light reflecting characteristics of ceiling panels and, therefore, it is important that the panels all be located at the same level beneath the support members. Although minor differences would not initially appear to be a problem, they are readily visible on a ceiling, although such difference may not be detected on a vertical wall surface. Therefore, in ceiling systems where a high quality concealed system is desired, the panels must accurately align with the grid support members and the individual panels must be positioned at one level below the support members. As can be appreciated, tolerance variations in the panels and variations due to the installer make this problem quite difficult.

The present invention seeks to mitigate these problems by providing a suspended ceiling system which accurately aligns the panels with the grid network and positions them at approximately the same level beneath these members. Furthermore, the invention provides a system wherein access to the space above the ceiling is achieved by removing any one of the tiles in a simple manner.

SUMMARY OF THE INVENTION

A suspended ceiling system, according to the present invention, comprises a plurality of ceiling panels and a plurality of support elements arranged in a grid-like manner to cooperatively support and accurately position the ceiling panels beneath the support elements. The panels include a body member bound on the upper edge by a reinforcing edge member which accurately defines the upper edge of the panel. The panels are faced with a sheet material which extends about the lower edge of the panel for securement to the sides thereof. The support elements have upper and lower portions, with the lower portion having a flange and a downwardly extending alignment stud centered with respect to the flange. Securement means associated with the reinforcing edge member and the upper portion of the support elements is provided for fastening the panels in place beneath these elements. With this structure, the edge member cooperates with the alignment stud to align the edges of adjacent panels and the flange cooperates with the reinforcing edge member to position the panels beneath the grid members a predetermined distance.

According to an aspect of the invention, a frame member is disclosed for use in suspended ceiling systems with the frame member having a first arm and a second arm to define a generally L-shaped cross-section. One arm of the frame member includes an inwardly directed projection along the entire length thereof, which is accessible from the exterior of the arm. Such a frame member positively engages a recess provided in the body member of a panel, with this inward projection also providing a simple means of securing the frame members in a miter joint. These frame members are preferably made of aluminum and produced by extrusion. The frame members may be provided with a clip engaging portion, including a generally C-shaped channel extending in the length of the frame member with a camming surface at the entrance of the channel to define a recess behind the camming surface, whereby a spring clip may be cammed into the recess and positively maintained in the channel by the camming surface.

According to another aspect of the invention, a suspended ceiling system comprises a plurality of grid support members, a plurality of ceiling panels each having a body member, preferably of an acoustical dampening material, a reinforcing edge secured about the top edge of the panel and extending down the side thereof, and spring means hingedly secured to each of the panels and releasably secured to one of the grid members. With this structure, the spring means maintains the panels in positive abutting contact against the grid members in one position and in a second position the spring means is selectively disengagable for suspending a ceiling panel generally perpendicular to the grid members, thereby allowing access to the space above the ceiling without fully removing the panel.

A ceiling panel, according to the present invention, for suspension in a ceiling system comprises a frame member and a body member with the frame member being generally L-shaped in cross-section for positioning on the upper surface of the body member. This frame member extends at least partially down the edge of the body member and has an inwardly directed projection on the side edge thereof for engaging a slot provided in the body member to positively maintain this member relative to the frame. The frame member completely bounds the periphery of the body member to accurately define the edges thereof.

According to a further aspect of the invention, a grid network for supporting a plurality of ceiling panels is disclosed with this grid network comprising a plurality of support elements interconnected by junction members. Each of the support elements has an upper and lower flange separated by a web member to form a generally I-shaped cross-section and the junction members have a plurality of slots for receiving the webs of the support members. These slots are spaced about the periphery of the junction member in a predetermined pattern. The slots receive the web of the support element between the flanges and include means for maintaining the position of the support element associated with the junction member. According to a preferred aspect, four vertical slots are provided about a junction member with the slots equally spaced about the periphery thereof. Each slot has out-turned end portions which cooperate with the upper flange of a support element in combination with a clip member to positively maintain the support element in connection with the junction member.

According to a further preferred aspect of the invention, the support elements and junction members are made of aluminum and produced by extrusion.

BRIEF DESCRIPTION OF THE DRAWINGS

Preferred embodiments of the invention are shown in the drawings wherein:

FIG. 7 is an exploded perspective view of a junction member and support elements;

FIG. 8 is a side view of a junction member and a connected support element;

FIG. 9 is a perspective view of a two piece junction member which slidably interconnects;

FIG. 10 is a vertical section taken through the clip member and support element when inserted in a junction member;

FIG. 11 is a perspective view illustrating the junction member and support elements connected for suspension beneath the support steel;

DETAILED DESCRIPTION OF THE PREFERRED EMBODIMENTS

Figure 1:
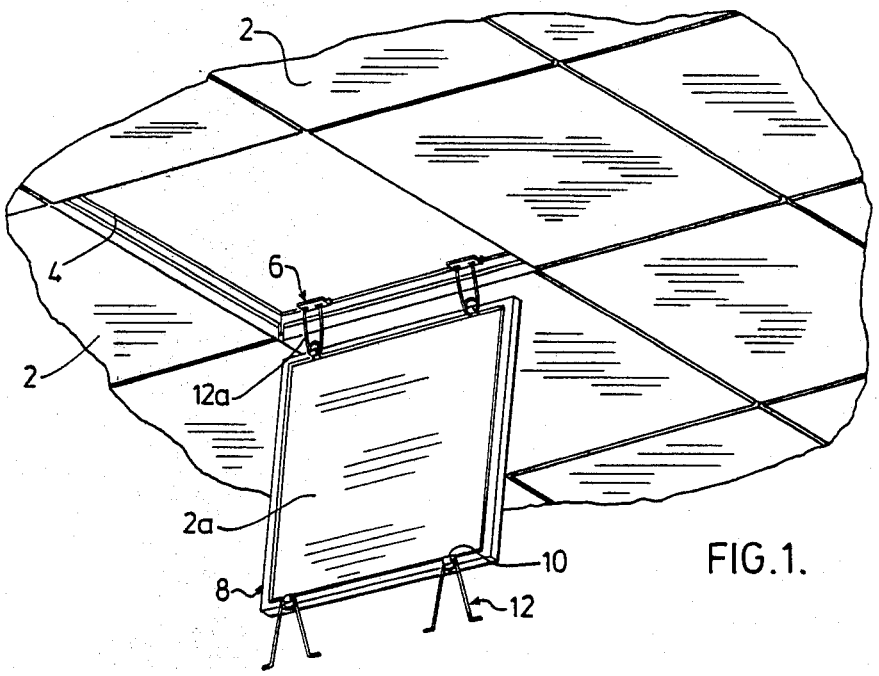
FIG. 1 is a partial perspective view of the ceiling system according to the present invention.

A portion of a suspended ceiling panel system is shown in FIG. 1 having a number of ceiling panels 2 supported beneath support elements 4 through the combination of the bracket 6 and the torsion spring 12 which is clipped to the edge of the panel. As can be seen, one of the ceiling panels 2*a* has been temporarily removed from the ceiling system and is hanging generally perpendicular to the support elements 4 by torsion springs 12*a*. The panels of the ceiling system are all secured by torsion springs in combination with brackets and, therefore, may be removed if necessary. However, it can be appreciated that, in the case of partial panels or panels located along the periphery of the panelled ceiling, special support arrangements may be necessary, as exemplified in FIG. 18.

Figure 2:
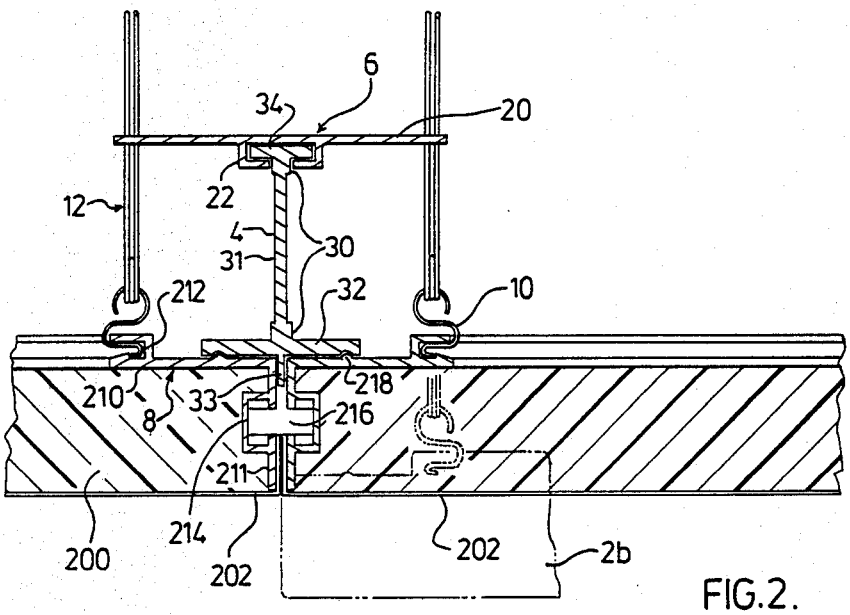
FIG. 2 is a vertical section illustrating the relationship between the framed ceiling panels and the support elements.

The vertical section of FIG. 2 clearly illustrates the various components of the system. The support elements 4 are generally I-shaped in cross-section with an upper flange 34 and a lower flange 32 separated by a web member 31. The web member, adjacent both the upper and lower flanges of the support element, is thickened at areas 30 to facilitate connection of these support elements with a junction member, shown in FIG. 7.

The panel 2 includes a frame member 8 about the upper edge of the panel to accurately define the periphery thereof. This frame member includes a clip engaging portion 212, an upper arm 210 and a lower arm 211 with an inwardly directing projection 214 on the arm 211 of the frame member. This inward projection engages panel member 200 of a material such as fiberglass, mineral board or wood fiber board which has been recessed to receive the projection 214. Because the frame member defines the periphery of the body member 200, the interaction of the projection 214 with the recessed portion of the body member assures the frame member is positively secured to the panel.

Beneath the lower edge of the structural element 4 is an alignment stud 33 which cooperates with the frame members of adjacent panels to accurately position these panels in alignment with the structural element 4. During installation, the structural elements 4 are secured to a junction member (not shown) which is secured beneath the support steel or other supporting surface and adjusted to define the desired grid network. Once this has been accomplished, the cooperation of alignment studs 33 with the arms 211 of adjacent panels assures the panels align and, as such, provides a more accurate ceiling system. The upper arm 210 cooperates with the lower edge of the flange 32 to positively locate the panels at the proper height beneath the support elements and minimizes any deviation between the height of installed panels.

Figure 3:
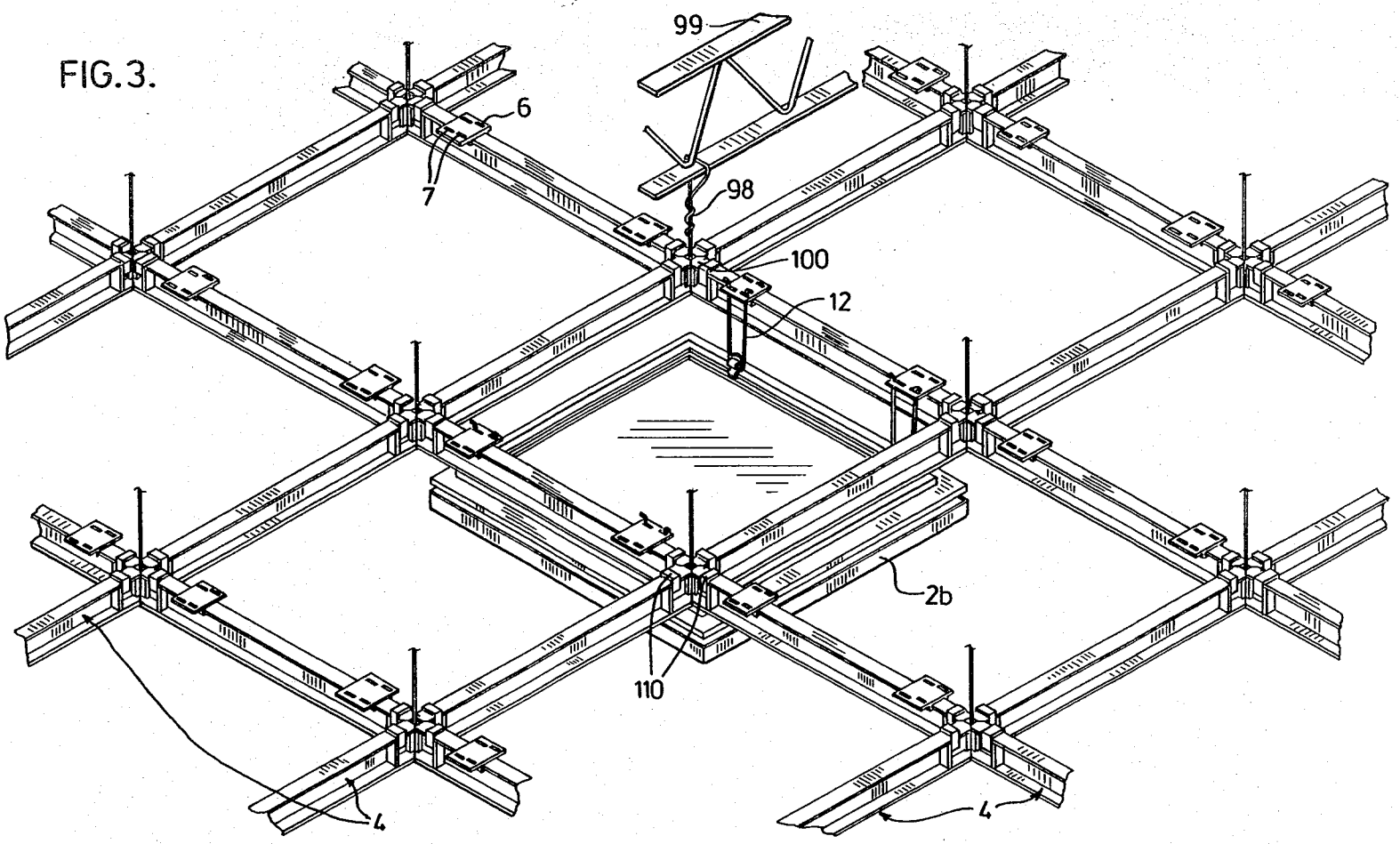
FIG. 3 is a partial perspective view illustrating the support elements interconnected beneath the support steel with one panel suspended below the support elements prior to final installation.

The sliding support bracket 6 has a lower portion 22 which engages the flange 34 of the support element and slides along this flange which acts as a rail for the support bracket. The bracket has a wing portion 20 which extends either side of the support element for engaging the torsion springs and in so doing, positively locates the panel relative to the support elements 4. The panel member *2b*, shown in dotted lines, illustrates the securement of a panel to the support elements. The first step in the preferred procedure is the hanging of two of the torsion springs connected to a panel to the floating brackets, as shown in FIG. 1, such that the panel hangs perpendicularly below the support elements. The lower free end of the panel is then moved upwardly to engage the other torsion springs with floating brackets on the opposite support element. After this has been completed, the panel will be generally parallel to the grid system, but located below the support elements generally as shown in FIG. 3 and in dotted lines in FIG. 2. After this has been completed, the installer merely needs to push the panel upwardly against the support elements where the framed panel cooperates with the lower flange and the alignment stud of the support element to accurately position the panel with respect to alignment and height below the support elements. It can be appreciated that the support elements and particularly the lower flange and alignment stud thereof surround the upper edge of a panel when secured beneath the support elements.

The view in FIG. 3 is from above the ceiling system looking downwardly onto the grid network and it can be seen that the grid network, which is the combination of junction members 100 and the support elements 4, is positioned beneath the support steel 99 by any suitable method, such as wire member 98. Clip members 110 cooperate with the junction member 100 and the support elements 4 for positively locating and locking the support elements to the junction member. The floating brackets 6 are secured to the upper flanges 34 of the support elements prior to installation of the support elements in the junction member. These floating brackets have been provided with two slots 7 either side of the web member for engaging the torsion springs 12 and the sliding of these brackets along the upper flange 34. The sliding of clip member 10 within the channel portion 212 of the frame of the ceiling panel simplifies the installation as the bracket 6 can slide and align itself with the position of the clip member. In this manner, accuracy in positioning of the clip and the floating bracket is not required as these components will self-align when the panel is moved upwardly against the support elements.

Figure 4:
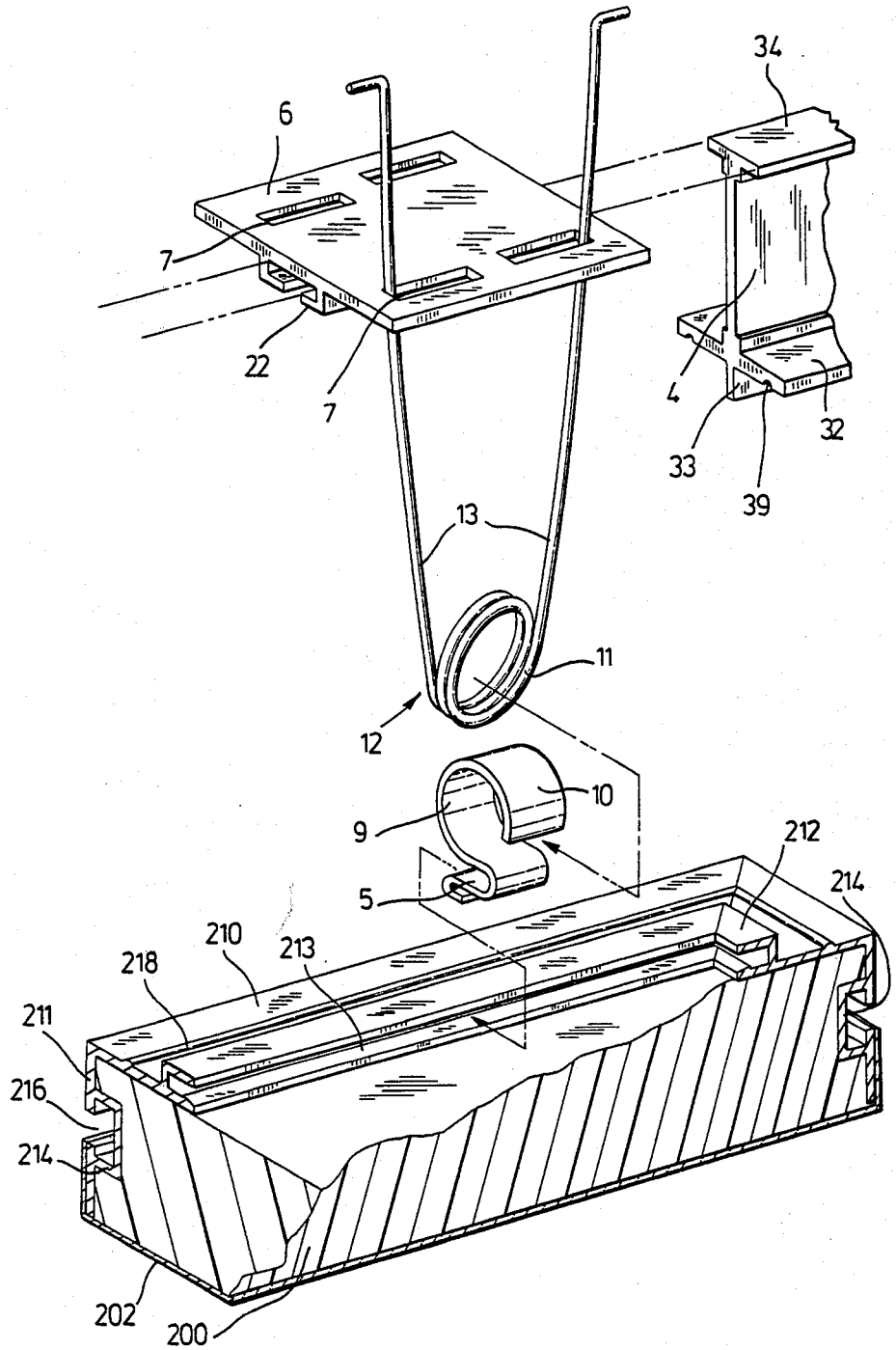
FIG. 4 is an exploded partial perspective view showing the method of securing the ceiling panel beneath the support elements.

Further details of the bracket 6 and the support element 4 and the cooperation of the support element with the framed panel can be seen with respect to the exploded view of FIG. 4. The torsion spring 12 has a centrally located coil 11 and two outwardly extending leg portions 13 which frictionally interact with slots 7 of an associated bracket member 6. The coil portion 11 is inserted within the clip member 10 in the upper portion of the clip shown as 9. This clip member may be made of a rolled steel with the lower portion of the clip having deformable bottom portion 5. This bottom portion is snapped into the channel 212 of a frame member, past the camming surface 213 into the recess therebehind and positively maintained therein as the bottom portion of the clip 5 extends and thus locks the clip within the recessed portion.

As previously stated, the lower portion 22 of the bracket member 6 is slipped onto the upper flange 34 of the support element 4 and essentially floats along this surface. The upper arm of the frame member has been provided with a raised bead portion 218 which cooperates with a similar shaped recess 39 located in the lower flange 32 of the support element 4. The positive pressure of spring 12 within the slots 7 urges the ceiling panel to always remain in positive engagement beneath the flange 32 of the support element and as such provides a positive sealing pressure on bead 218 within recess 39. As this seal is provided along the periphery of the entire frame member, it essentially seals each panel with the grid network and, allows the area above the ceiling to be used as a return air plenum. Again as the panel is moved upwardly against the support elements 4, arm 211 of the frame member cooperates with alignment stud 33 to accurately align the panels and the upper arm 210 cooperates with the lower flange 32 to position the panels at a fixed height beneath the support elements.

Figure 5:
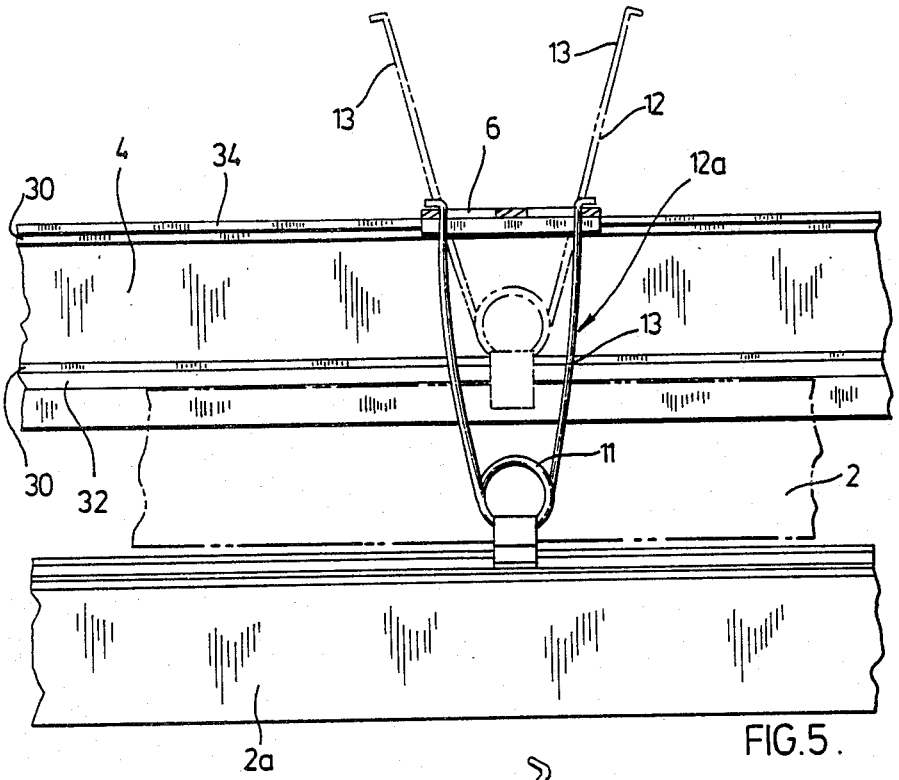
FIG. 5 is a partial side view showing the suspension of the ceiling panels beneath the support elements.

FIGS. 4 and 5 show the various positions of torsion spring 12 which secures the panel to the support elements 4 and maintains a positive pressure urging the panel and particularly sealing bead 218 into contact with recess 39 of the support element. The torsion springs, shown in FIG. 4, are under stress and legs 13, if not restrained by slots 7, would move outwardly and relax the spring force. Even in the final installed position of FIG. 4 (spring 12), a spring force remains. However, as the spring moves upwardly between slots 7, it reaches a point where the spring force may be reduced by further upward movement of the spring. Once this point is reached the spring will move upwardly with considerably force and in so doing, bring the panel into positive sealing engagement with the structural element. The exterior of slots 7, which receive legs 13 of the torsion spring, are spaced a distance greater than the diameter of coil 11 to provide this positive sealing pressure. In the lower position illustrated by spring 12*a*, the legs 13 bow outwardly beyond the exterior of slots 7 and in so doing, urge the spring to the downward position. However as the spring moves upwardly additional stress is exerted on the spring due to inward movement of the bowed legs until a point is reached where spring stress can be relieved by further upward movement of the spring. Spring 12 of FIG. 4 has passed this point and spring stress is relieved by further upward movement of the spring. If the spring was not connected to the panel, it would snap upwardly until coil 11 was in contact with the bracket 6.

As can be seen in FIG. 4, the inward projection 214 of the frame member is of generally rectangular cross-section and has a slot 216 opening through the arm 211 of the frame member. In this manner, a channel is produced about the sidewalls of the ceiling panel and this will be used to positively secure the frame members relative to one another. Further details of this will be discussed with respect to FIG. 6.

Two positions of the ceiling panel are shown in FIG. 5. The lower ceiling panel 2*a* is suspended beneath the support elements 4 by torsion spring 12*a*, with the out turned ends of leg 13 positively maintaining the torsion spring secured to the bracket 6, such that the panel cannot be removed without further inward deformation of the torsion spring 12*a*.

The panel and spring shown in dotted lines and designated 2 and 12 respectively, is in the installed position beneath support element 4 and legs 13 of spring 12 have moved outwardly as the panel is brought into contact with the support members.

Figure 6:
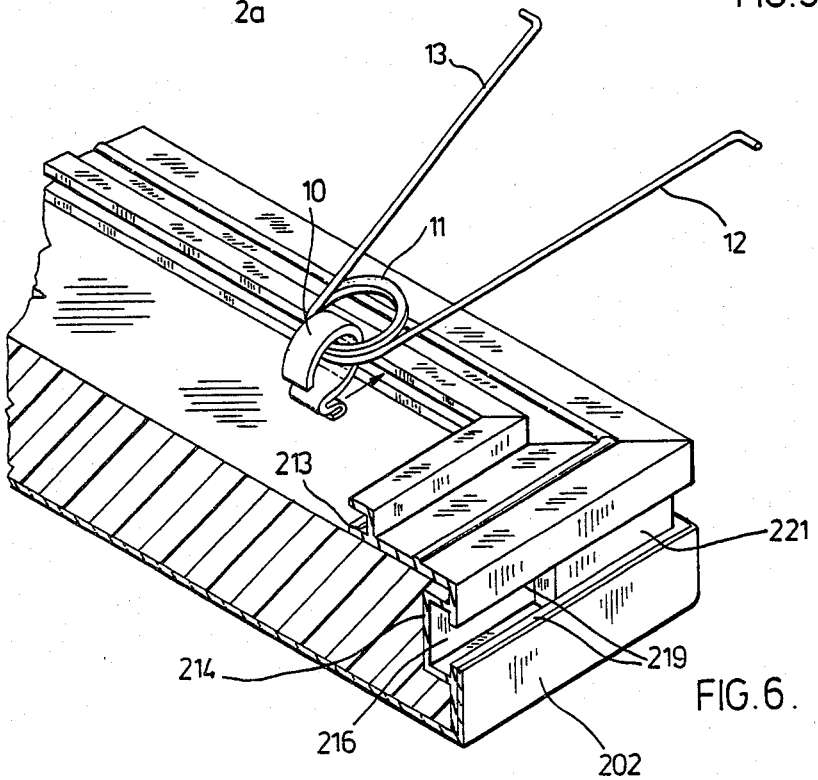
FIG. 6 is a partial perspective view illustrating the insertion of the clip member in the channel member provided on the support element of the ceiling panel.

One possible method of securing the frame members about a ceiling panel is shown in FIG. 6, wherein a connecting member 221 has been positioned within the inwardly directed projection 214 and positively located within the channels thereof. Member 221 provides a friction fit with the channel and includes a second arm which is received within the channel of the adjoining frame member. In this way, the frame members are provided with a 45 degree miter line and joined and maintained in this joint by the frictional engagement of member 221 with each of the frame members. The projections 219 assure the member 221 is maintained within the channel. FIG. 6 also illustrates that the torsion spring 12, once secured to a clip member 10, can be used as a handle for urging the clip member within the channel 212. In this way, the force required to deform the clip member and urge it past camming surface 213 can easily be accomplished by the installer. However, it can be appreciated that other clip arrangements or ways of securing the clip member to this channel are possible. For example, the clip member could merely be secured to the channel member prior to completion of the frame member about the periphery of a panel.

The sheet facing material 202, shown applied to the body member 200, is normally of a class A fire rating and extends across the entire lower surface of the ceiling panel and partially up the sides of the panel to the junction with slot 216 of the frame member. This material will normally be glued to the surface and is present primarily for cosmetic reasons. The fabric is positioned to the outside of the arm 211 of the frame member with slot 216 simplifying the cutting by acting as a guide surface for a knife. This particular arrangement positively secures the fabric to the ceiling panel and also serves to hide alignment stud 33 when the ceiling system is installed. This is best illustrated in FIG. 2, where it can be seen that the cloth 202 of abutting panels is of a thickness sufficient to cover alignment stud 33 to provide a fully concealed panel system. However, it can also be appreciated that this fabric is compressible and allows a thin L-shaped tool to be inserted between abutting panels, whereby the tool may be rotated to positively engage with slot 216 of one panel allowing this panel to be easily removed by downward pulling of the tool. Therefore, the inward projection 214 serves to positively locate the body member 200, provides a channel into which a corner joiner may be inserted for joining of abutting frame members and also facilitates removal of the ceiling panels as desired.

The exploded view of FIG. 7 illustrates the preferred method of joining structural elements 4. The junction member 100 has a number of slots 102 vertically extending about the periphery of the junction member in a predetermined geometric pattern. Each of these slots has out-turned end portions 106 to define a channel 108 between the out-turned end portions and the body of the junction member. As can be seen, the support elements 4 are secured to the junction member by inserting the web of these members within the slots 102 with the upper flange 34 and the lower flange 32 straddling the junction member and thereby accurately determining the vertical position of the support elements with respect to the junction member. After the web has been inserted within slot 102, a clip 110 is moved downwardly and received within insets 35 of the upper flange 34 and within the channel 108 of the junction member. In this way the support element is positively locked within the junction member.

Each of the slots 102 has a width 50 which corresponds to the approximate width of the thickened portions 30 of the web member. These thickened portions provide a frictional fit with the slot and are, therefore, positively engaged by the slot members. In this manner, a very tight fit may be maintained between the web and the slots which would not be possible if the web was of constant thickness. The required force to insert members 4 within the slot is a function of the frictional engagement of thickened portions 30 within these slots and this insertion may easily be accomplished by hand in the field. The lower flange 32 has been provided with a miter cut 41 at the end thereof such that a miter joint is provided between adjacent frame members beneath the junction member. Furthermore, to facilitate positive engagement of the support elements within the junction member and to provide overlapping of the body of the junction member with the flanges 32 and 34, the web member 31 has been removed near the end of the support elements to provide overlapping of the flanges with the body of the junction member. This further improves the structural strength of the system. As can be seen in FIG. 8, a structural member 4 has been positively locked with the junction member and alignment stud 33 extends beneath the junction member 100 to essentially frame the panel and provide a seal about the periphery thereof.

In FIG. 9, the junction member 100*a* is of a two piece construction having sections 101*a* and 101*b* which are identical and include engagement portions 160 which are received within slots 161 of a second component. In this way the halves may slide together to form one integral junction as illustrated by 100 in FIG. 7. It can be appreciated that other arrangements are possible for splitting of the junction member which is desirable to allow this member to be extruded easily. The required detail and tolerances on the slots 102 would make this component extremely difficult to extrude in one piece; however, by splitting the junction member the extrusion operation is greatly simplified particularly in light of the centre aperture 162.

As shown in FIG. 11, this aperture 162 is used to receive a threaded bolt member 500 to which a support wire 98 may be fastened. By using the threaded bolt 500, the grid system may be adjusted with respect to height below the support steel and simplifies the accurate positioning of the grid system. FIG. 10 also indicates how the slots 102 only engage the thickened portions 30 and how the clip member 110 positively locks these members within the junction member. The upper flange 34 of the support elements leaves a centre opening on the upper surface of the junction member to facilitate insertion of bolt 500. This bolt also serves to lock the pieces of the junction member to one another. The frictional engagement of the thickened portions 30 within the slot area 102 as well as the overlapping relationship of flanges 34 and 32 which are positioned immediately above and below the junction member, provide a more structurally stable grid network.

Figure 12:
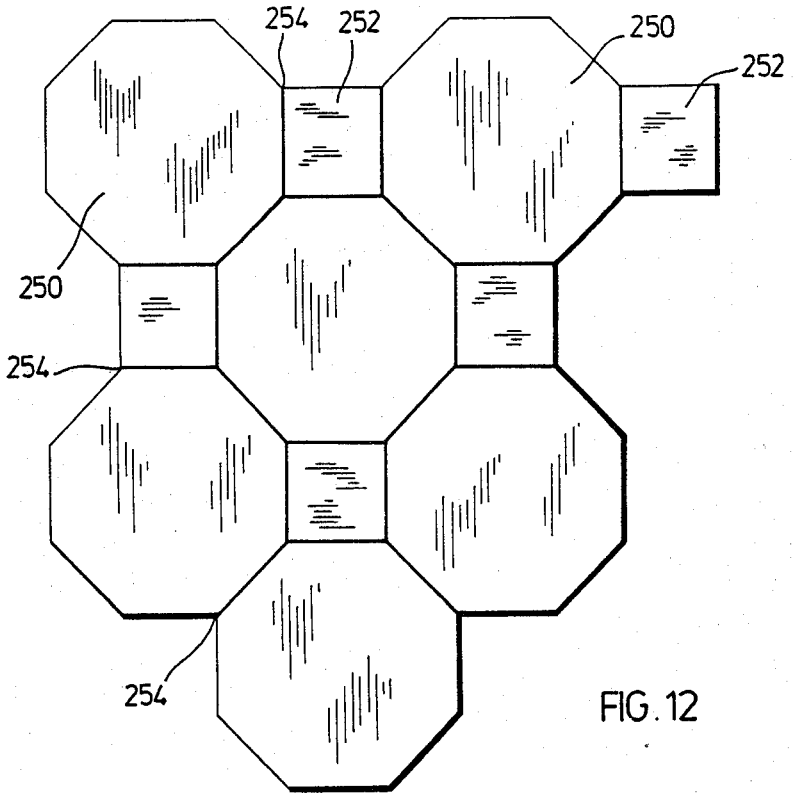
FIG. 12 is a bottom view of a ceiling panel system using octagonal panels in combination with square panels.

The suspended ceiling panel system shown in FIG. 12 utilizes octagonal ceiling panels 250 in combination with square ceiling panels 252 to define a unique ceiling panel system. As disclosed in the previous drawings, each of these panels 250 and 252 have a reinforced edge member secured about the periphery thereof, which cooperates with the support elements to align and position the panels at a particular height below the support elements. At each corner intersection 254 of a panel 250 and 252, a Y-shaped connector is required having three arms, two of which are perpendicular to one another with the third arm being at an angle of 135 degrees to the other two.

Figure 13:
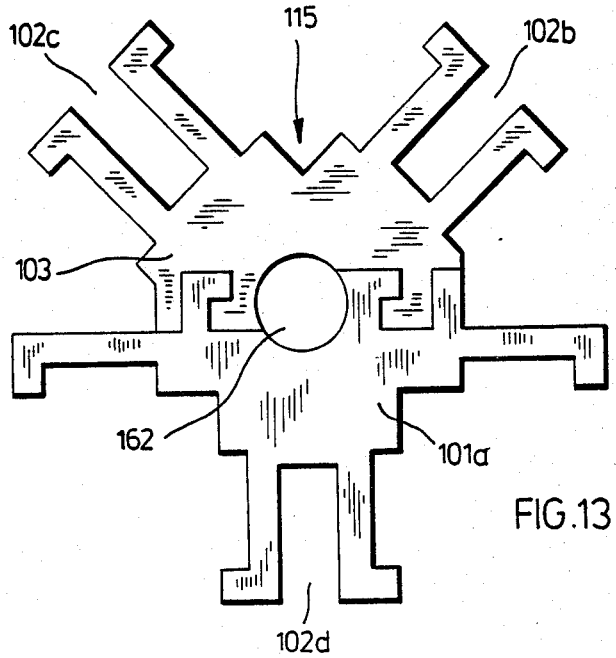
FIG. 13 is a cross-section through the Y-junction member used to connect structural elements for the octagonal ceiling panel system.

Such a junction member is shown in FIG. 13 having slots 102*b, c* and *d*, with slots b and c being perpendicular to one another and slot d being at an angle of 135 degrees relative to the other two. The Y-shaped connector generally designated 115 is again of a two piece construction utilizing component 101*a* of the junction member 100 shown in FIG. 9 and a new extrusion 103 which contains slots 102*c* and *b*. A center aperture 162 is still provided into which a bolt member may be threaded for securing the junction member below a supporting surface. It can be appreciated that the support elements previously described can be used with this junction member to be received within slots 102*b* through *d* and in so doing, defining the necessary grid network to support the ceiling panels shown in FIG. 12.

Figure 14:
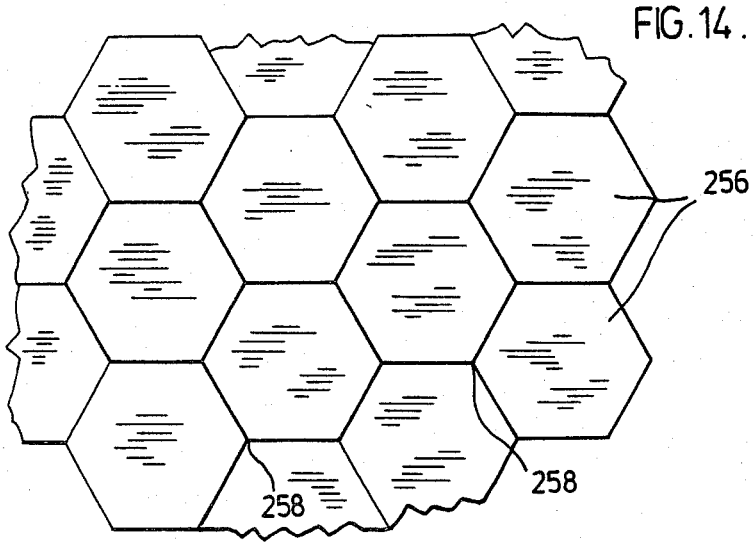
FIG. 14 is a bottom view of a suspended ceiling panel system using hexagonal ceiling panels.
Figure 17:
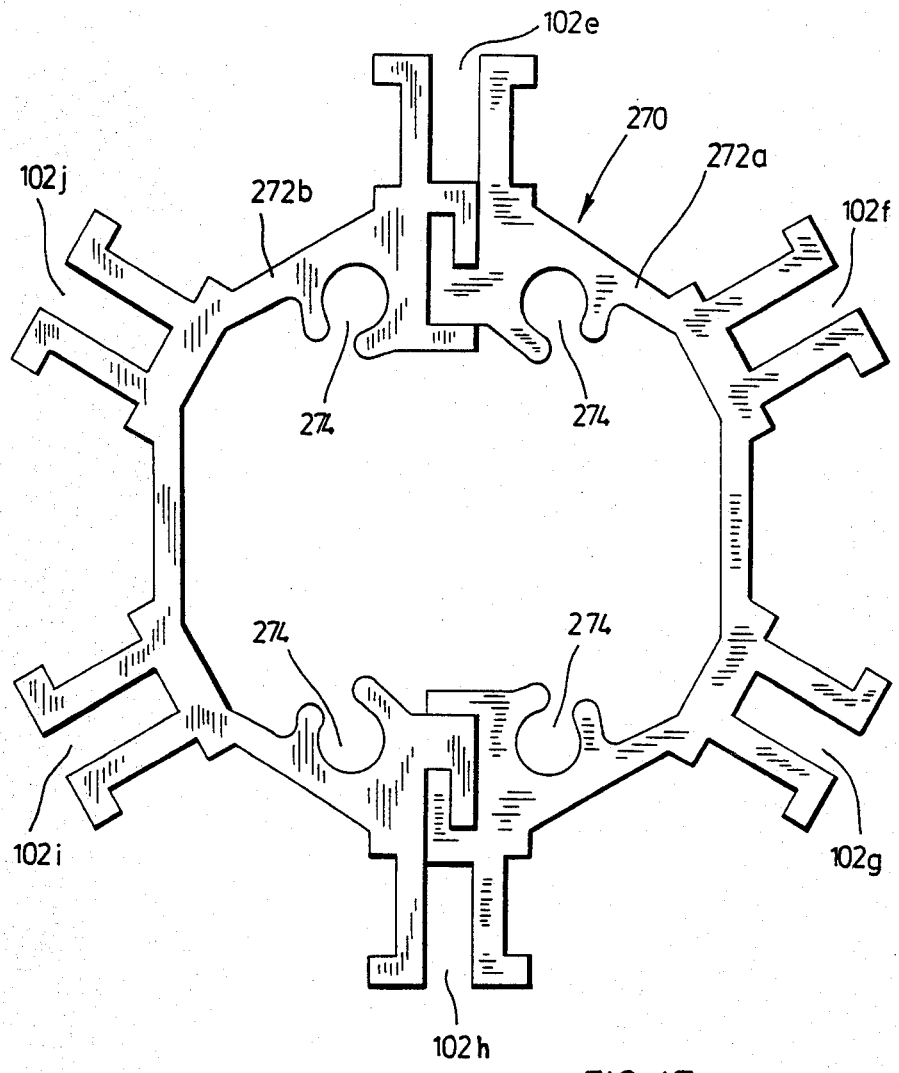
FIG. 17 is a cross-section through a six-way connector for use with any of the panel systems according to FIGS. 14 through 16.

The hexagonal ceiling panels 256 of FIG. 14 again are framed such that these panels can align with the support network in a manner previously described and are covered such that the alignment stud of the support elements is always hidden. The junction member, used with this panel system provided at any of the corner intersections 258, requires three slots at 120 degrees relative to one another and one possible connector is shown in FIG. 17.

Figure 15:
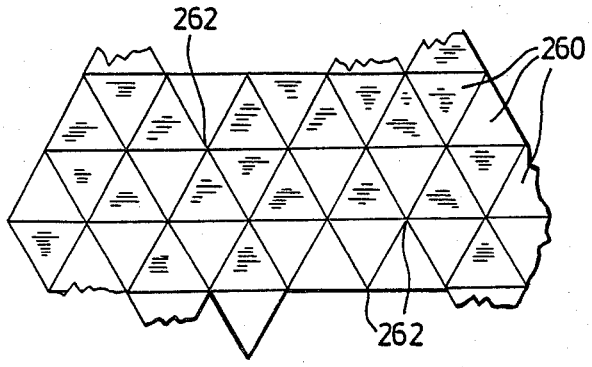
FIG. 15 is a partial bottom view of a ceiling system using triangular panels.

In FIG. 15, a ceiling panel system is shown comprising a plurality of similar triangular-shaped panel members 260 and is disclosed having intersection points 262 between panels. As can be appreciated with triangular panels, a six-way connector is required at each of the junctions 262 and the intersections member shown in FIG. 17 can be used for this purpose.

Figure 16:
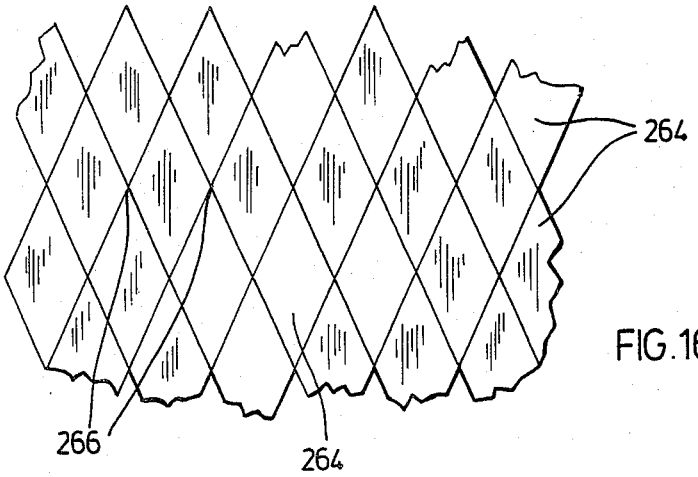
FIG. 16 is a partial bottom view of a ceiling panel system using diamond-shaped panels.

A slight variation of the triangular-shaped panels is shown in FIG. 16, wherein diamond-shaped panels 264 are possible and a four-way connector is required at each of the intersections 266 of the panels. Again the connector shown in FIG. 17 can be used for this particular ceiling panel system.

The six-way connector generally shown as 270 comprises two identical pieces 272*a* and 272*b* which slide together to form the resulting junction member. Six slots 102*e* through *j* are spaced about the periphery of the junction member at 60 degrees relative to adjacent slots. The structural elements 4 are secured to the junction member 270 in a manner similar to that described with respect to FIG. 7 and this junction member positions the structural elements at 60 degrees relative to one another, should all the slots be utilized. All slots 102*e* through *j* would be used in the case of the triangular ceiling panels shown in FIG. 15; however, only slots f, g, i and j would be used in case of the diamond-shaped panels of FIG. 16. In the case of the hexagonal ceiling system of FIG. 14, slots e, g, and i would be used or slots j, f and h. The junction member 270 of FIG. 17 does not have a center aperture 162 as this junction member is larger than those previously described and as such the centre of the junction member is hollow to minimize the amount of material used during extrusion of the components 272*a* and *b*. However, a number of recesses 274 have been provided in each of the components 272*a* and *b* for receiving a bolt member to secure the junction member from a supporting surface.

Therefore, it can be appreciated from reviewing FIGS. 12 through 17 that various geometric patterns may be achieved, according to the grid network and ceiling panels of the present invention need not be restricted to rectangular or square ceiling panels.

Figure 18:
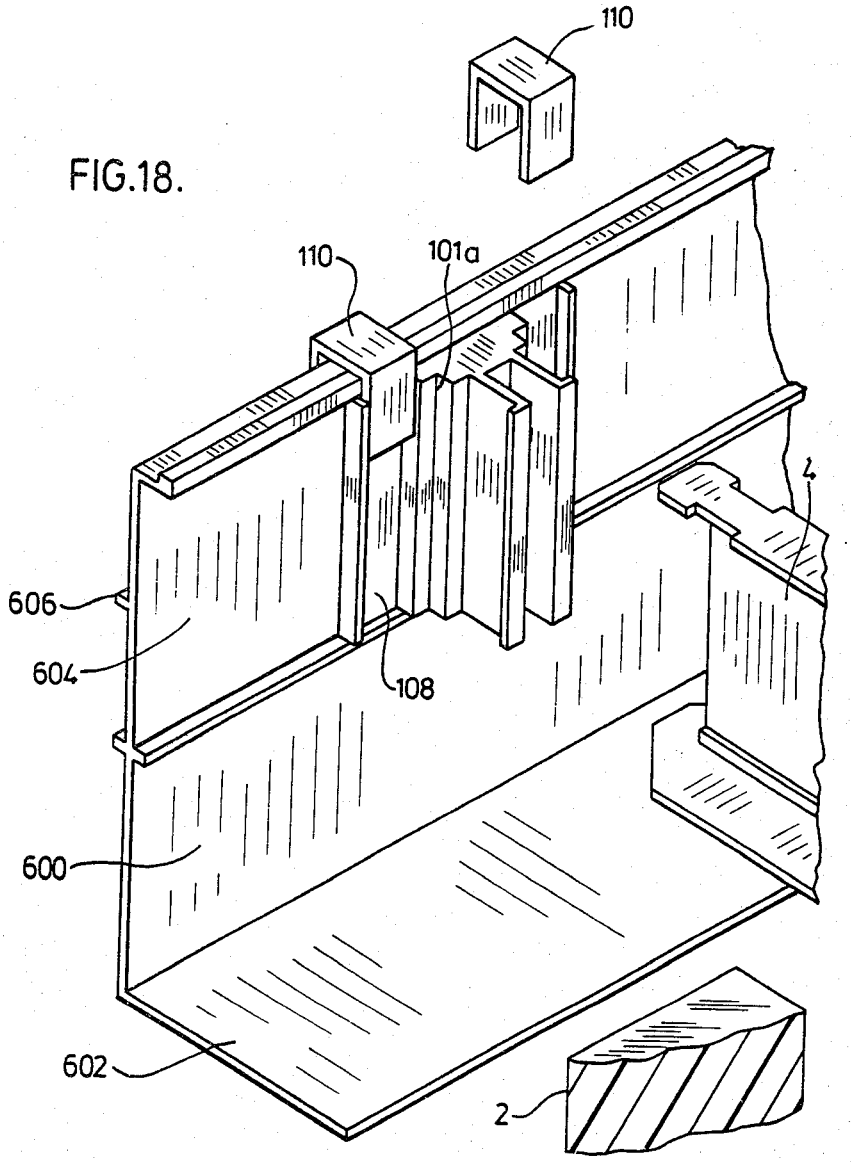
FIG. 18 is a partial perspective exploded view of a wall connector for use with any of the various shaped panel systems.

The exploded perspective view of FIG. 18 shows the wall bracket 600 which is secured to the wall of the room which is to receive the concealed panel system and provides one method for securing the grid network to the walls. This bracket 600 would be secured about the side walls at a height such that flange 602 would be just below the lower finished surface of the panel 2 being installed, whereby the flange 602 provides support for this panel. The upper portion of the wall bracket 600 is provided with a channel 604 into which any of the segments of the junction members may be secured. Component 101*a* is shown received within channel 604 and maintained within this channel by clip members 110 engaging channels 108 of the component, as well as the rear face of the bracket member 600 which is spaced from the support wall by bead 606. In this way, component 101*a* may be secured to the bracket member and slide within the channel 604 for alignment with the remaining grid network. Although this bracket member 600 has been described with respect to component 101*a*, it similarly can engage junction components 272*a*. This wall bracket would be secured about the entire periphery of the room at the precise level desired for the grid network with these junction components then brought into engagement with the bracket member for receiving the support elements 4 and in so doing, provides a simple method for assuring the grid network and support elements are all at the same height at the walls. Furthermore, flange 602 provides a support surface should only a portion of the panel be required to complete the ceiling system.

This type of support structure shown in FIG. 18 is required as walls of rooms are not normally perpendicular or planar and as such, the support system must be sufficiently flexible to accommodate these variations.

Different shaped panel edges can be used if desired and the rectilinear edge shown in the drawings is only the preferred edge shape. With the rectilinear lower edge of the panel, the frame 8 extends down the entire side of the panel so that the body member 200 need not be chemically treated to reinforce the edge. However in some instances, it may be desired to produce a panel having a cove edge, bullnose edge or chamfer edge in which case the body member 200 will extend below frame 8 and, if necessary, have the exposed edge reinforced, or the frame member could be extruded in the desired shape for securement to the panel. As in the rectilinear panel, the fabric cover extends upwardly along the edge of the panel to hide the alignment stud.

In order to meet various fire ratings for suspended ceilings, it is preferred that all clips, springs, frame members, support elements and junction members be made of a metal or heat resistant material. Furthermore, the sheet material facing the panel should have a class A fire rating.

In some applications, it may be desired to reflect sound rather than dampen sound transmission and in this case, a thin reflective surface would be positioned between body member 200 and the sheet material 202. In most cases, acoustical dampening is required or desired and the body member may be made of a fiberglass having a density of 4 to 15 pounds per cubic foot. A fiberglass core having a density of 7 pounds per cubic foot has proven sufficient for panels of approximately five feet by five feet without experiencing an unacceptable amount of bowing of the panel. This bowing is a function of the structural strength of the body member.

Therefore according to the present invention, a concealed ceiling system is established having both an improved ceiling panel as well as a unique grid network made up of a plurality of support elements in combination with junction members. Cooperation between the support elements and the frame panel members is achieved due to a downwardly extending alignment stud to achieve a ceiling panel system which is easier to install without experiencing difficulties with respect to varying height of the panels beneath the grid network and variations in the alignment of adjacent panels. This system also provides a fully concealed ceiling panel system, where the grid network is completely hidden by the ceiling panels while also allowing easy access to the space above the ceiling panels by removal of any one of the panel members. According to the unique securement method of the panel to the grid network, a panel may be suspended at 90 degrees to the support element if access is desired to the plenum defined above the ceiling system, or this position may merely be used to simplify the installation of the panels, whereby the panels may be installed by one person. One edge of the panel may be secured to the grid system and the panel then rotated upwardly to allow securement of the second side.

Although preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A ceiling panel frame member for use in suspended ceiling systems, said frame member having a first arm and a second arm to define a generally L-shaped cross-section, the first arm of said frame member including an inwardly directed projection along the entire length thereof, said projection being accessible from the exterior of said arm, said second arm having a clip engaging portion including a generally C-shaped channel extending in the length of said frame member with a camming surface at the entrance of said channel to define a recess behind said camming surface whereby a spring clip may be cammed into said recess and positively maintained in said channel by said camming surface.

2. A frame member as claimed in claim 1, wherein said second arm contains a raised bead portion on the upper surface which is parallel to the edge of said arm and runs the entire length of said arm.

3. A suspended ceiling system comprising a plurality of grid support members, a plurality of ceiling panels each having a body member and a reinforcing edge secured about the top edge of the panel and extending down the side edge thereof, spring means hingedly secured to each of said panels and releasably secured to one of said grid members, wherein said spring means maintains said panel in position against said grid members in one position and in a second position said spring means is selectively disengagable for suspending a ceiling panel generally perpendicular to said grid members, said grid members have a downwardly extending alignment stud which cooperates with the reinforced edge of said panels to accurately align panels with the grid members when positioned thereagainst, said panels including a decorative cover on the lower surface of the panel which extends upwardly along the edges of the panel, whereby when two adjacent panels are secured to the grid members the alignment stud therebetween is not visible due to the decorative cover of said panels extending upwardly along the edges thereof.

4. A suspended ceiling system as claimed in claim 3, wherein said decorative cover is made of a fabric having a thickness approximating half of the thickness of said alignment stud.

5. A suspended ceiling system as claimed in claim 3, wherein said body member is an acoustical dampening material selected from the group consisting of fiberglass having a density oQ 4 to 15 pounds per cubic foot, mineral board and wood fiber board.

6. A suspended ceiling system as claimed in claim 5, wherein said reinforced edge extends fully down the edge of said body member.

7. A suspended ceiling system as claimed in claim 3, wherein said spring means includes a plurality of torsion springs spaced about the periphery of said panels.

8. A suspended ceiling system as claimed in claim 3 or 7, wherein said grid members are generally I-shaped in cross-section having an upper flange and a lower flange separated by a web member, the edges of said upper flange providing a rail along which a spring securement bracket slides, said bracket having a lower securement portion slotted to receive the upper flange of said grid member and a wing portion which extends either side of said securement portion for engaging said spring means beyond the lower flange of said grid member when slidably secured to said upper flange.

9. A suspended ceiling system comprising a plurality of ceiling panels and a plurality of structural members arranged in a grid-like manner to cooperatively support and accurately position said ceiling panels, said panels including a body member bound on the upper edge by a reinforcing edge member which accurately defines the upper edge of said panel, said panels being faced with a sheet material which extends about the lower edge of said panel for securement to the sides thereof, said structural members having upper and lower portions with said lower portion having a flange and a downwardly extending alignment stud centered with respect to said flange, securement means associated with said reinforcing edge member and the upper portion of said structural members for fastening said panels in place beneath said structural members wherein said edge member cooperates with said alignment stud to align the edges of adjacent panels and said flange cooperates with said reinforcing edge member to position the panels beneath the grid members a predetermined distance.

10. A suspended ceiling system as claimed in claim 9, wherein said sheet material is positioned below said alignment stud when a panel is positioned below said structural members and is of a thickness such that adjacent panels cover said alignment stud when viewed from below said ceiling panels.

11. A suspended ceiling system as claimed in claim 9, wherein said body member is of an acoustical dampening material and said reinforcing edge member has two arms generally perpendicular to one another to define a generally L-shaped cross-section for bounding the upper edge of the panel along the top and side thereof, the arm along the side edge of the panel including an inwardly directed portion for positively engaging said body member, said securement means including a torsion spring and a clip, said torsion spring having two extending leg portions and a central coil portion which is engaged by said clip, said clip cooperating with the free end of the arm extending along the upper edge of the panel for securing said panel beneath said structural members.

12. A suspended ceiling system as claimed in claim 11, wherein the inwardly directed portion of said arm alongside said panel defines a substantially closed cavity into which a joining member may be fitted for securing abutting edge members of a panel in a miter joint, said cavity having a slot opening to the side edge of the panel to facilitate removal of the panel from the structural members.

13. A suspended ceiling system as claimed in claim 9, 11 or 12, wherein said flange of said structural member and the arm of said reinforcing edge member cooperated to seal along a bead of one of these components which is received in a recess of the other component, said securement means providing a positive pressure urging said structural member and said reinforcing edge member into abutting contact.

14. In a suspended ceiling system a grid network for supporting a plurality of ceiling panels said grid network comprising a plurality of support elements interconnected by junction members, each of said support elements having an upper and lower flange separated by a web member to form a generally I-shaped cross-section, each of said junction members having a plurality of slots spaced about the periphery of said junction member in a predetermined pattern, each slot sized to receive and engage a web and contact said web adjacent the junction of said web and said flanges to provide a snug fit between said web and said junction member, and means for maintaining the position of said support element so associated with said junction member, said maintaining means including a clip which is securable to said junction member in a manner to engage and positively secure one of said support member.

15. In a suspended ceiling system as claimed in claim 14, wherein said slots are vertical and are equally spaced about said junction member.

16. In a suspended ceiling system as claimed in claim 15, wherein six slots are provided and said junction member comprises two identical components.

17. In a suspended ceiling system as claimed in claim 14, wherein four vertical slots are provided on said junction member equally spaced about the periphery of said junction member, each slot being defined by two parallel arms extending radially outwardly from said junction member and each arm having an out-turned end portion, said upper flange including means for cooperating with a clip member and said out-turned end portions to positively maintain each support element to said junction member.

18. In a suspended ceiling system as claimed in claim 14 or 17, wherein said web has at least one thickened portion of a size to provide a friction fit within the slot of a junction member.

19. In a suspended ceiling system as claimed in claim 14, wherein said web member has two thickened portions at opposite ends of said web immediately below said upper flange and above said lower flange, said thickened portions providing a friction fit within the slots of said junction member when inserted therein.

20. In a suspended ceiling system as claimed in claim 19, wherein said lower flange of said support elements are cut to provide a miter joint beneath said junction member.

21. In a suspended ceiling system as claimed in claim 19, wherein the ends of said support elements are modified by removing a portion of said web such that said flanges project beyond said web, said upper flange having inset portions positioned to cooperate with said clip member and said out-turned end portions, such that when one of said support elements has been received in a slot of a junction member, said flanges overlap with said junction member and said clip member may be received in said insets and behind said out-turned end portions to positively lock said one support element and junction members.

22. In a suspended ceiling system as claimed in claim 21, wherein said flanges lie immediately above and below said junction member to positively locate said support element relative to said junction member.

23. In a suspended ceiling system as claimed in claim 14, 17 or 21, wherein said junction members are made of aluminum and produced by extrusion, each of said junction members being made of at least two components which slidable interengage to form said junction member.

24. In a suspended ceiling system as claimed in claim 14, 17 or 21, wherein said junction member includes an aperture passing vertically through the centre of said junction member into which a connection member is screwed for fastening said junction member to the underside of a support surface.

25. A ceiling panel frame member for use in suspended ceiling systems said frame member having a first arm and a second arm to define a generally L-shaped cross-section, the first arm including an inwardly directed projection along the length thereof, said second arm including a clip engaging portion at the free end thereof which runs the length of said frame member, said clip engaging portion defining a generally C-shaped channel with a restricted opening to define a recess within said channel whereby a spring clip may be forced through the restricted opening of said channel and positively maintained within the recess of said channel.

26. A ceiling panel frame member as claimed in claim 25, wherein a camming surface is provided at the entrance to said channel which partially defines the restricted opening of said channel whereby such spring clip is cammed into said recess.

* * * * *